US010482820B2

(12) United States Patent
Lin et al.

(10) Patent No.: US 10,482,820 B2
(45) Date of Patent: Nov. 19, 2019

(54) METHOD OF COMPENSATING LUMINANCE OF OLED AND DISPLAY SYSTEM USING THE SAME

(71) Applicant: NOVATEK Microelectronics Corp., Hsin-Chu (TW)

(72) Inventors: Chun-Chieh Lin, Taipei (TW); Hua-Gang Chang, Hsinchu County (TW); Hsueh-Yen Yang, Taoyuan (TW); Shang-Yu Su, Hsinchu (TW); Feng-Ting Pai, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 271 days.

(21) Appl. No.: 15/187,809

(22) Filed: Jun. 21, 2016

(65) Prior Publication Data

US 2017/0365202 A1 Dec. 21, 2017

(51) Int. Cl.
*G09G 3/3258* (2016.01)

(52) U.S. Cl.
CPC ... *G09G 3/3258* (2013.01); *G09G 2300/0819* (2013.01); *G09G 2320/0233* (2013.01); *G09G 2320/0285* (2013.01); *G09G 2320/045* (2013.01)

(58) Field of Classification Search
CPC ..... G09G 3/3258; G09G 3/3233; G09G 2300/0819; G09G 2300/0861; G09G 2310/0251; G09G 2310/0262; G09G 2320/0233; G09G 2320/0285; G09G 2320/029; G09G 2320/043; G09G 2320/045
See application file for complete search history.

(56) References Cited

U.S. PATENT DOCUMENTS

| | | | | |
|---|---|---|---|---|
| 7,414,599 | B2 | 8/2008 | Chung | |
| 8,259,044 | B2 | 9/2012 | Nathan | |
| 8,264,478 | B2 | 9/2012 | Kim | |
| 8,988,329 | B2 | 3/2015 | Yoon | |
| 2009/0174649 | A1 | 7/2009 | Kim | |
| 2014/0152721 | A1* | 6/2014 | Byun | G09G 3/3208 345/691 |
| 2014/0354711 | A1* | 12/2014 | In | G09G 3/3233 345/691 |
| 2015/0077314 | A1 | 3/2015 | Kim | |
| 2016/0086548 | A1* | 3/2016 | Maeyama | G09G 3/3258 345/690 |

(Continued)

FOREIGN PATENT DOCUMENTS

| | | |
|---|---|---|
| CN | 102103827 A | 6/2011 |
| CN | 102968954 A | 3/2013 |

(Continued)

*Primary Examiner* — Sahlu Okebato
(74) *Attorney, Agent, or Firm* — Winston Hsu

(57) ABSTRACT

A method of compensating luminance of an organic light-emitting diode (OLED) operated with a transistor in a pixel cell of a display panel includes measuring a first parameter of the transistor and a parameter of the OLED, and generating a lookup table accordingly; converting original display data to target display data according to the lookup table; outputting the target display data to the pixel cell; and compensating a second parameter of the transistor when the target display data is received by the pixel cell.

6 Claims, 7 Drawing Sheets

(56) References Cited

U.S. PATENT DOCUMENTS

| | | | | |
|---|---|---|---|---|
| 2017/0287390 | A1 | 10/2017 | Lee | |
| 2017/0289805 | A1* | 10/2017 | Hong | G09G 3/3233 |

FOREIGN PATENT DOCUMENTS

| | | | |
|---|---|---|---|
| CN | 103413515 | A | 11/2013 |
| CN | 104021761 | A | 9/2014 |
| CN | 103236237 | B | 4/2015 |
| CN | 104658474 | A | 5/2015 |
| CN | 103177685 | B | 6/2015 |
| CN | 104700761 | A | 6/2015 |

* cited by examiner

METHOD OF COMPENSATING LUMINANCE OF OLED AND DISPLAY SYSTEM USING THE SAME

BACKGROUND OF THE INVENTION

1. Field of the Invention

The present invention relates to a method of compensating luminance of an organic light-emitting diode (OLED), and more particularly, to a method of compensating luminance of an OLED operated with a transistor in a pixel cell and a display system thereof.

2. Description of the Prior Art

An organic light-emitting diode (OLED) is a light-emitting diode (LED) in which the emissive electroluminescent layer is a film of organic compound, where the organic compound can emit light in response to an electric current. OLEDs are widely used in displays of electronic devices such as television screens, computer monitors, portable systems such as mobile phones, handheld game consoles and personal digital assistants (PDAs). An active matrix OLED (AMOLED), which is driven by a thin-film transistor (TFT) which contains a storage capacitor that maintains the pixel states to enable large size and large resolution displays, becomes the mainstream of the OLED displays.

In a general OLED display, each pixel cell includes an OLED for displaying a gray scale in the pixel. The pixel cell receives a voltage signal from a timing controller. A TFT then converts the voltage signal into a driving current, which drives the OLED to emit light. The luminance of the OLED is determined by the driving current of the OLED. However, in the OLED display, the TFT indifferent pixels may possess an error or mismatch in the device parameter, which may result in different voltage-to-current conversion behaviors. In addition, there may also be a mismatch in the luminous efficiency of the OLED. After a long-time operation, the OLED display may undergo degradations in voltage-to-current conversion and luminous efficiency. Therefore, the uniformity of the OLED display may be influenced since different locations on the OLED display may possess different levels of degradations.

In order to improve the uniformity of the OLED display, an efficient compensation method for OLED and TFT parameters has become an important problem to be solved.

SUMMARY OF THE INVENTION

It is therefore an objective of the present invention to provide a method of compensating luminance of an organic light-emitting diode (OLED) operated with a transistor in a pixel cell and a display system thereof, which achieves a wide compensation range without complex computation.

The present invention discloses a method of compensating luminance of an OLED operated with a transistor in a pixel cell of a display panel. The method comprises measuring a first parameter of the transistor and a parameter of the OLED, and generating a lookup table accordingly; converting original display data to target display data according to the lookup table; outputting the target display data to the pixel cell; and compensating a second parameter of the transistor when the target display data is received by the pixel cell.

The present invention further discloses a display system, which comprises a display panel, an external compensation module and a controller. The display panel comprises a plurality of pixel cells, each of which comprising an OLED operated with a transistor. The external compensation module is used for measuring a first parameter of the transistor and a parameter of the OLED, and generating a lookup table accordingly. The controller is used for converting original display data to target display data according to the lookup table, and outputting the target display data to one of the plurality of pixel cells. The second parameter of the transistor is compensated when the target display data is received by the pixel cell.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
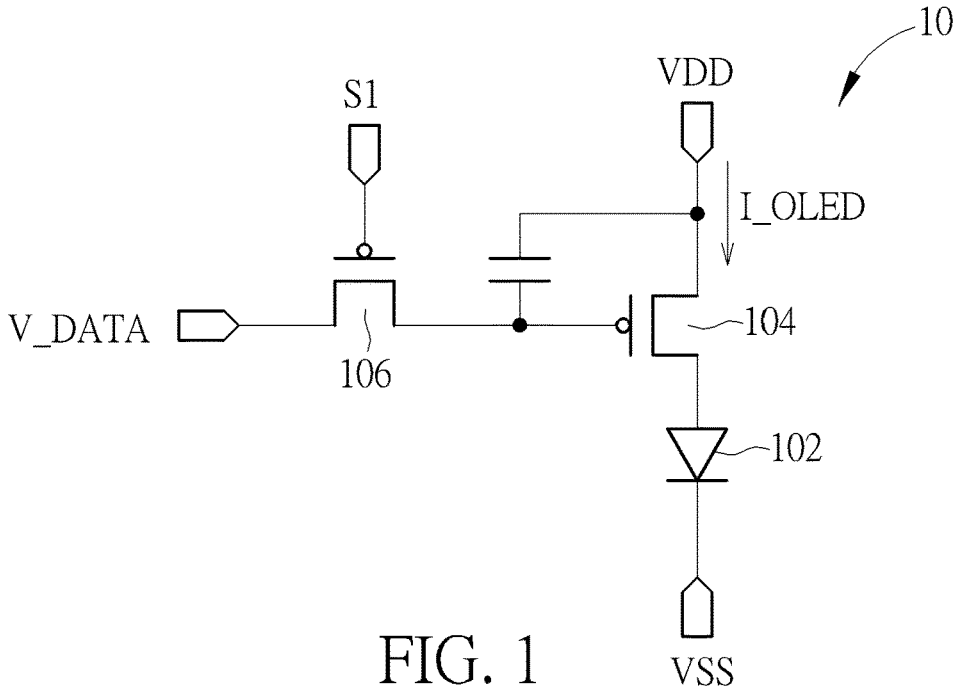
FIG. 1 is a schematic diagram of a general pixel cell of an OLED display.

In order to solve the uniformity problem in the organic light-emitting diode (OLED) display, the industry has developed several methods for compensating the parameters which may vary across the OLED display. Such parameters include the electronic mobility and the oxide capacitance of the driving transistor, which may be a thin-film transistor (TFT), of the OLED, the threshold voltage of the transistor, and the luminous efficiency of the OLED. In detail, please refer to FIG. 1, which is a schematic diagram of a general pixel cell 10 of an OLED display. The pixel cell 10 includes an OLED 102 coupled to a driving transistor 104 which may be a TFT, and a scan switch 106 for scanning the display data for the pixel cell 10. A controller such as the timing controller of the OLED display outputs the voltage display data V_DATA to the pixel cell 10, and outputs the scan signal S1 to control the pixel cell 10 to receive the voltage display data V_DATA. The driving transistor 104 then converts the voltage display data V_DATA to a driving current I_OLED, and the conversion follows the formula of a metal oxide semiconductor filed effect transistor (MOSFET) operated in the saturation region:

$$I_OLED=K(VDD-V_DATA+Vth)^2,$$

where K is a parameter including the electronic mobility and the oxide capacitance of the driving transistor 104, and Vth is the threshold voltage of the driving transistor 104. These parameters may not be uniform across the OLED display due to process variations. Further, the OLED 102 may emit light according to the driving current I_OLED, where the luminous efficiency of the I_OLED, i.e., the efficiency of current-to-luminance conversion, may not be uniform due to process variations and/or degradations under long-time usage of the OLED display.

Therefore, the industry has developed several methods to compensate the non-uniform parameters. Common compensation methods include an internal compensation and an external compensation. The internal compensation is usually used for compensating the threshold voltage Vth, where a circuit design technique is applied in the pixel cell to eliminate the influence of the threshold voltage on the current-to-voltage conversion. However, the internal compensation method has a limited compensation range; that is, the internal compensation is not feasible if the mismatch of the threshold voltage exceeds a specific range, e.g., 0.3V. In such a situation, the internal compensation method is not applicable to an electronic product having a longer life.

Therefore, the external compensation method is applied to enhance the compensation range. According to the external compensation method, the pixel cell is coupled to an external compensation module, which measures the voltage variations and current variations in each pixel cell of the OLED display and estimates the luminous efficiency of the OLED. The controller of the OLED display then calculates the target voltage data according to the information obtained by the external compensation module, in order to provide different driving currents to achieve similar luminance in the OLED display. However, the external compensation method requires a great deal of calculation and thus consumes a lot of resources. This may reduce the efficiency of the controller. Specifically, the formula of MOSFET operation includes square calculation of the parameter Vth, which is complex and consumes many computation resources and memories.

Figure 2:
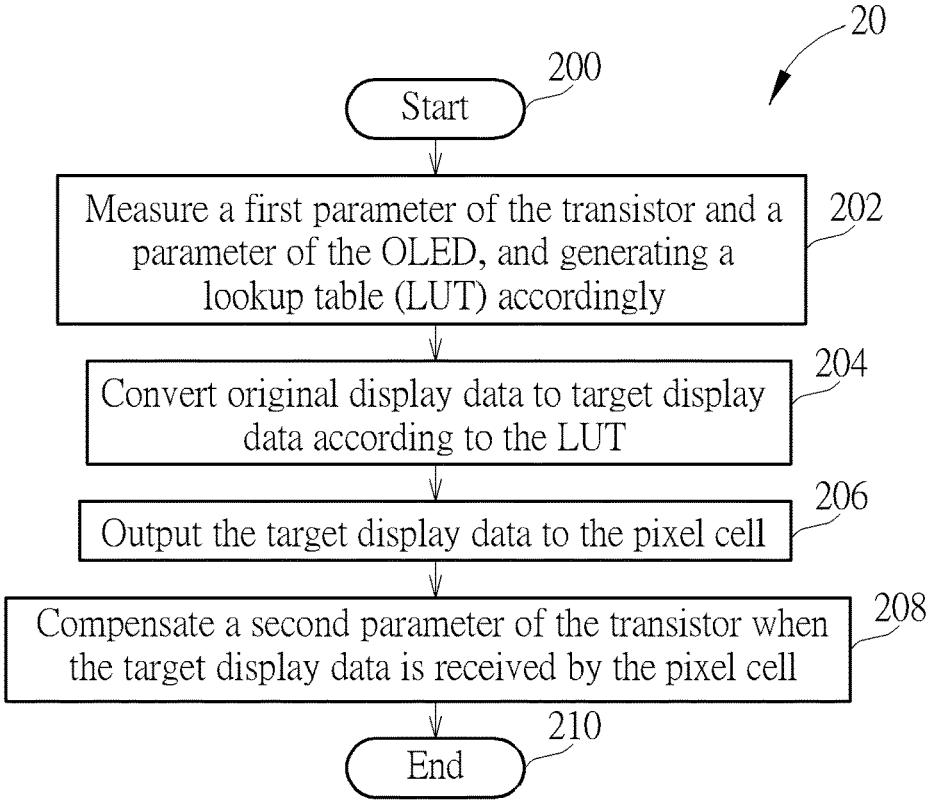
FIG. 2 is a schematic diagram of a compensation process according to an embodiment of the present invention.

The present invention provides a higher efficient compensation method relative to the conventional internal and external compensation methods. Please refer to FIG. 2, which is a schematic diagram of a compensation process 20 according to an embodiment of the present invention. The compensation process 20 may be implemented in an OLED display panel and used for compensating luminance of an OLED operated with a transistor, e.g., a TFT transistor, in a pixel cell of the OLED display panel. The compensation process 20 includes the following steps:

Step 200: Start.

Step 202: Measure a first parameter of the transistor and a parameter of the OLED, and generating a lookup table (LUT) accordingly.

Step 204: Convert original display data to target display data according to the LUT.

Step 206: Output the target display data to the pixel cell.

Step 208: Compensate a second parameter of the transistor when the target display data is received by the pixel cell.

Step 210: End.

According to the compensation process 20, the external compensation module coupled to the OLED display may measure a first parameter of the transistor and a parameter of the OLED, and the LUT is generated accordingly. The first parameter of the transistor may be the factor K in the MOSFET formula, which includes the electronic mobility and the oxide capacitance of the transistor. The parameter of the OLED may be the luminous efficiency of the OLED. The LUT indicates the parameter variations in each pixel cell and how to adjust the display data to compensate the parameter variations. The controller of the OLED display thereby converts original display data to target display data according to the LUT, and then outputs the target display data to the pixel cell. In other words, by adjusting the original display data to the target display data, the non-uniformity of parameters such as electronic mobility, oxide capacitance and luminous efficiency is compensated. Subsequently, the second parameter of the transistor may be compensated when the target display data is received by the pixel cell. In other words, the pixel cell may perform internal compensation to eliminate the second parameter, which may be the threshold voltage of the transistor.

In this manner, the non-uniformity in the threshold voltage of the transistor is eliminated via circuit designs in the pixel cell without any calculation. Therefore, the square calculation is omitted, which saves the computation resources and memories for complex calculation. In addition, the external compensation module provides a wider compensation range. The external compensation module measures the parameters related to the K factor for voltage-to-current conversion and the luminous efficiency of current-to-luminance conversion, which are linear conversions and easily processed by the external compensation module.

Figure 3:
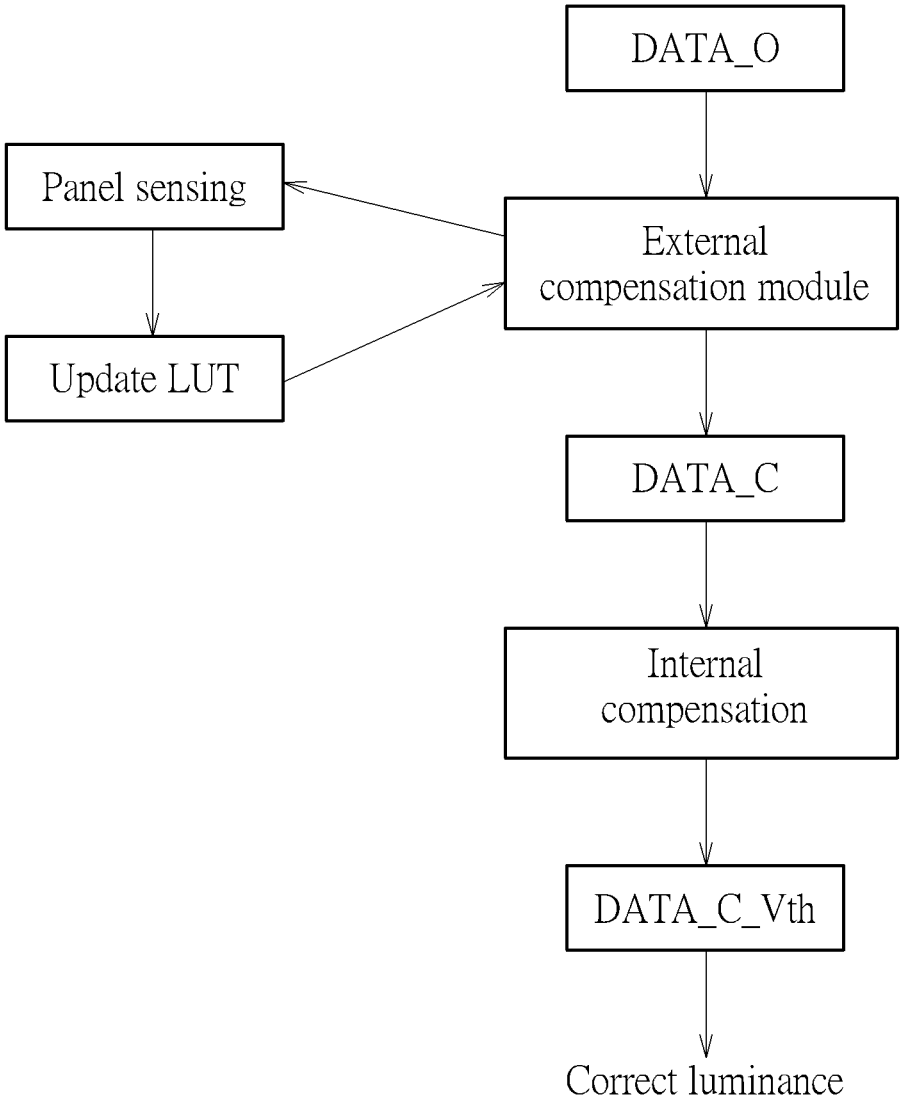
FIG. 3 is a schematic diagram of display data conversion according to an embodiment of the present invention.

Please refer to FIG. 3, which is a schematic diagram of display data conversion according to an embodiment of the present invention. As shown in FIG. 3, display data DATA_O is data to be displayed originally. The external compensation module may perform panel sensing and measure the required parameters to generate a LUT, and the controller may adjust the display data according to the LUT. Note that the external compensation module may perform the panel sensing periodically or at a predetermined time, e.g., after the OLED display is powered off. The external compensation module may update the LUT or notify the controller to update the LUT when the measured parameter changes. Therefore, the LUT reflects the statuses of the TFT and OLED, and indicates how to adjust the original display data DATA_O to the target display data DATA_C.

In an embodiment, the LUT includes an OLED LUT and a TFT LUT, where the OLED LUT indicates the degradation of luminous efficiency of the OLED and specifies how to adjust the display data DATA_O to compensate the luminous efficiency. The OLED LUT may include information as shown in Table 1:

TABLE 1

| OLED_LUT | X_1 | X_2 | X_3 | X_4 | . . . | X_m |
|---|---|---|---|---|---|---|
| Y_1 | 63 | 61 | 58 | 55 | . . . | 52 |
| Y_2 | 57 | 45 | 46 | 47 | . . . | 54 |
| Y_3 | 58 | 48 | 49 | 50 | . . . | 60 |
| Y_4 | 61 | 56 | 55 | 53 | . . . | 59 |
| . . . | . . . | . . . | . . . | . . . | | . . . |
| Y_n | 53 | 56 | 57 | 52 | . . . | 62 |

In addition, the TFT LUT indicates the mismatch of the K factor of the transistor and specifies how to adjust the display data DATA_O to compensate the mismatch of the K factor. The TFT LUT may include information as shown in Table 2:

TABLE 2

| TFT_LUT | X_1 | X_2 | X_3 | X_4 | . . . | X_m |
|---|---|---|---|---|---|---|
| Y_1 | 62 | 48 | 58 | 45 | . . . | 62 |
| Y_2 | 57 | 45 | 46 | 53 | . . . | 49 |
| Y_3 | 61 | 56 | 55 | 53 | . . . | 59 |
| Y_4 | 53 | 56 | 57 | 52 | . . . | 62 |
| . . . | . . . | . . . | . . . | . . . | | . . . |
| Y_n | 57 | 52 | 57 | 58 | . . . | 60 |

With Table 1 and Table 2, the display data may be converted from the original display data DATA_O to the target display data DATA_C according to the following formula:

$$\text{DATA_C} = \text{DATA_O} \times \frac{64}{\text{OLED_LUT}[X, Y]} \times \frac{64}{\text{TFT_LUT}[X, Y]}.$$

Note that X_1-X_m and Y_1-Y_n specify the location of the pixel cell, where the OLED display panel may include a plurality of pixel cells arranged in m columns and n rows, and different pixel cells may have different compensation values. The LUT Table 1 and Table 2 indicate the compensation values for converting the original display data DATA_O to the target display data DATA_C in each pixel cell. A smaller compensation value means that a greater adjustment should be performed on the display data.

Please keep referring to FIG. 3. The display data DATA_C is generated after the compensations for the electronic mobility and the oxide capacitance of the transistor and the luminous efficiency of the OLED are accomplished. An internal compensation is further performed to convert the display data DATA_C into the final display data DATA_C Vth in the pixel cell. This final display data DATA_C Vth may generate a correct luminance and the uniformity of the OLED display panel may be achieved.

Figure 4:
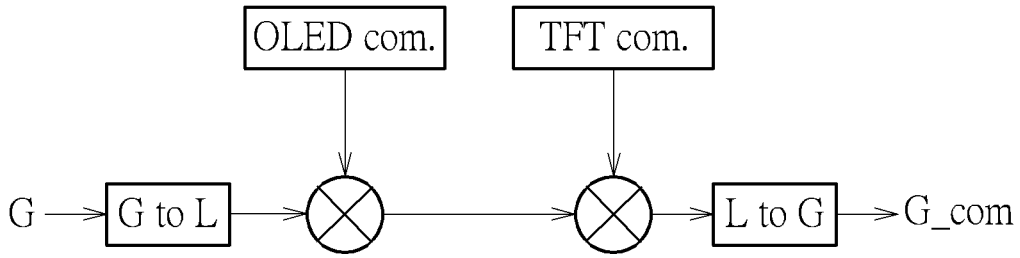
FIG. 4 is a schematic diagram of a detailed operation of the external compensation module to generate the lookup table according to an embodiment of the present invention.

Please refer to FIG. 4, which is a schematic diagram of a detailed operation of the external compensation module to generate the LUT according to an embodiment of the present invention. As shown in FIG. 4, the gray scale (G) corresponds to the voltage display data outputted by the controller. In order to achieve the linearity of OLED compensation and TFT compensation, the gray scale is first converted to the luminance (L) of the OLED.

Figure 5:
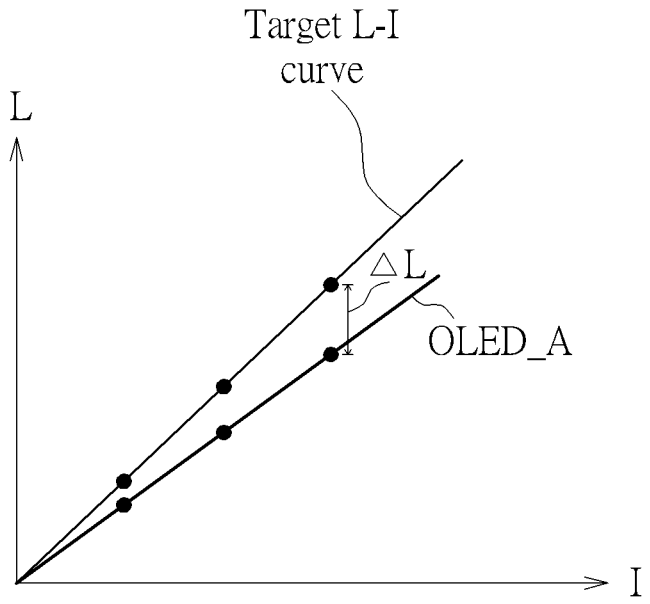
FIG. 5 is a schematic diagram of luminance-to-current conversion of the OLED behavior.

The OLED compensation is performed to compensate the luminous efficiency of the OLED. Please refer to FIG. 5, which is a schematic diagram of luminance-to-current (L-I) conversion of the OLED behavior. In the OLED compensation process, the external compensation module may measure the panel data and establish an L-I model OLED_A based on the measured data. The model OLED_A is then compared with the target L-I curve to show the variation of the luminous efficiency (ΔL) due to process variation and/or degradation after the usage of OLED display panel. Therefore, the OLED LUT may be configured with a compensation value which may compensate the mismatch between the measured model OLED_A and the target L-I curve.

Figure 6:
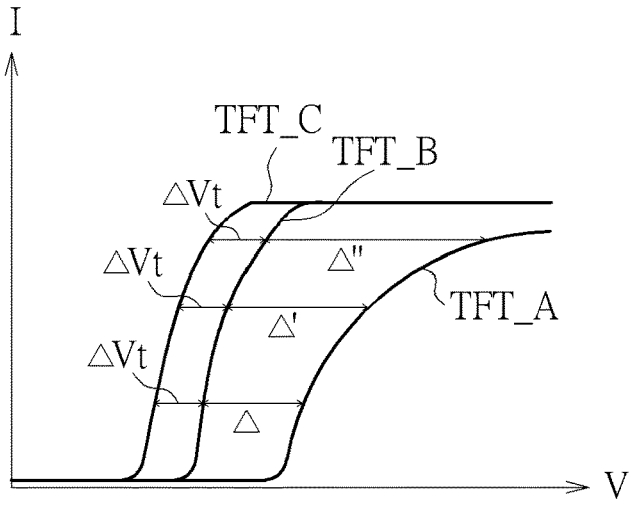
FIG. 6 is a schematic diagram of current-to-voltage conversion of the transistor behavior.

Subsequently, the TFT compensation is performed to compensate the electronic mobility and the oxide capacitance of the transistor. Please refer to FIG. 6, which is a schematic diagram of current-to-voltage (I-V) conversion of the transistor behavior. In the TFT compensation process, the external compensation module may measure the panel data and establish an I-V model TFT_A based on the measured data. The controller of the OLED display then performs TFT compensation to allow a voltage mismatch existing between the voltage value of the transistor and the target voltage value, where the voltage mismatch is within a specific range that is able to be dealt with by compensating the threshold voltage of the transistor. In detail, as shown in FIG. 6, a target I-V curve TFT_C indicates target values after entire compensation, and an I-V curve TFT_B shows a difference of threshold voltage (ΔVt) with the I-V curve TFT_C. The I-V curve TFT_A is then compared with the I-V curve TFT_B to show the voltage variation of the transistor due to process variation of the electronic mobility and the oxide capacitance. Therefore, the TFT LUT may be configured with a compensation value which may compensate the mismatch between the measured model TFT_A and the I-V curve TFT_B. Afterwards, the I-V curve TFT_B will be converted to the target I-V curve TFT_C in the next step of internal compensation. As shown in FIG. 4, after the OLED compensation and the TFT compensation, the luminance is converted back to the gray scale, and the controller may output display data to the pixel cell according to the compensated gray scale (G COM).

The internal compensation may be implemented by using circuit design techniques in the pixel cell, where the threshold voltage of the transistor is eliminated to compensate the mismatch of the threshold voltage. Examples of the circuit structure of the pixel cell are illustrated in FIGS. 7A-7E.

Figure 7A:
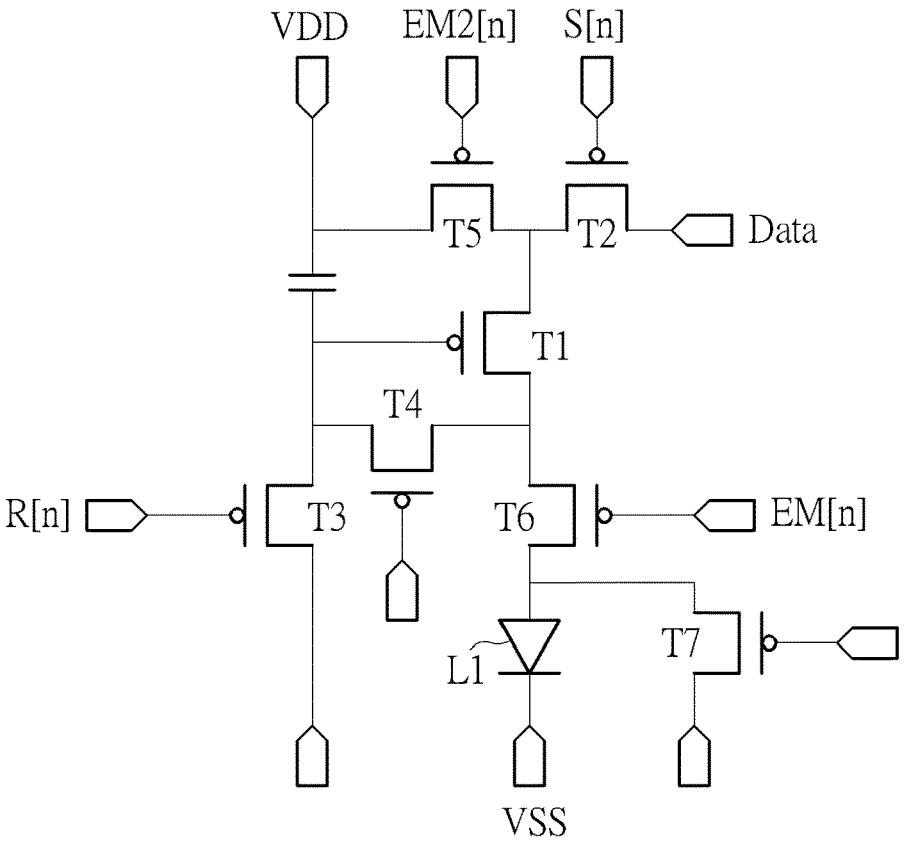
FIGS. 7A-7E illustrate examples of the circuit structure of the pixel cell.
Figure 7C:
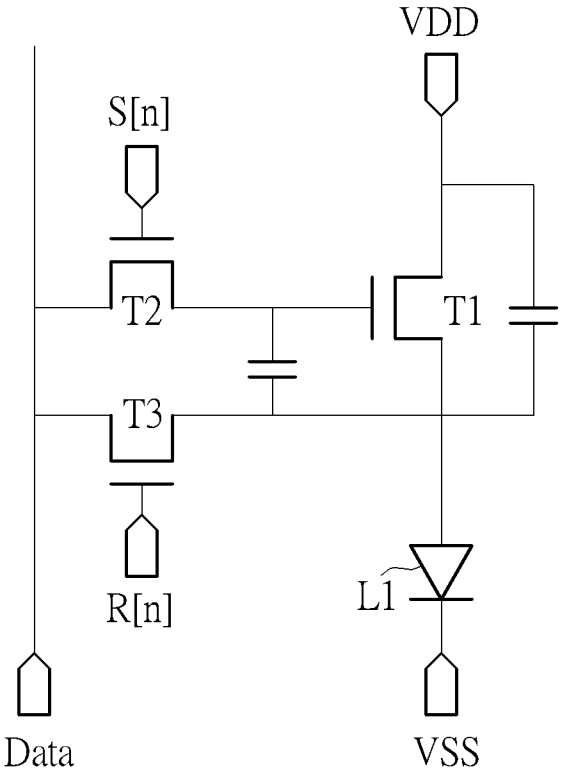
Figure 7B:
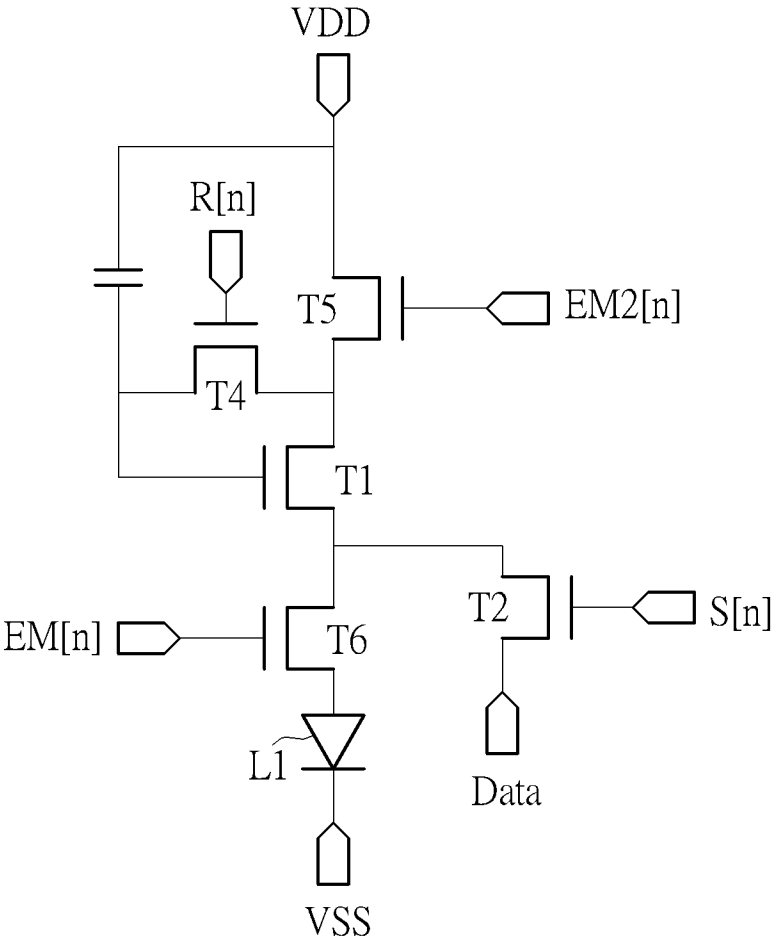
Figure 7E:
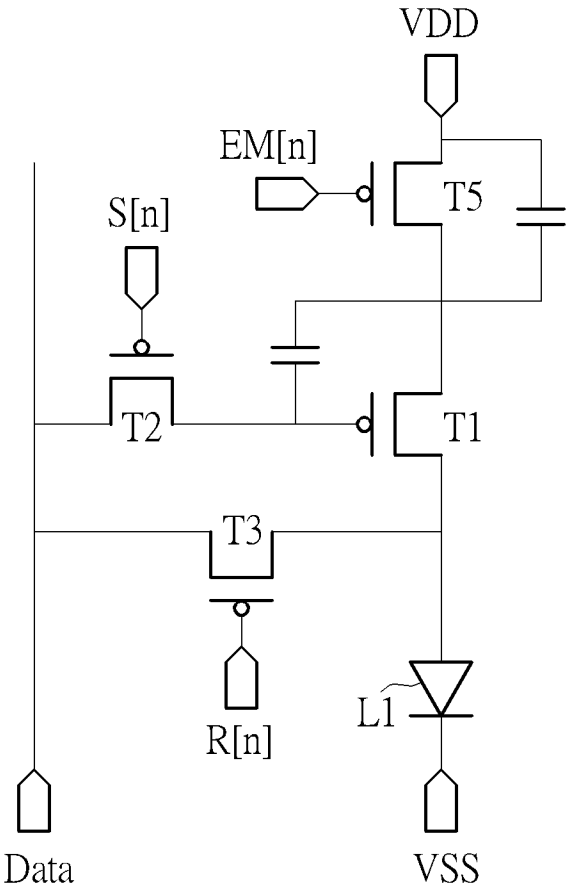
Figure 7D:
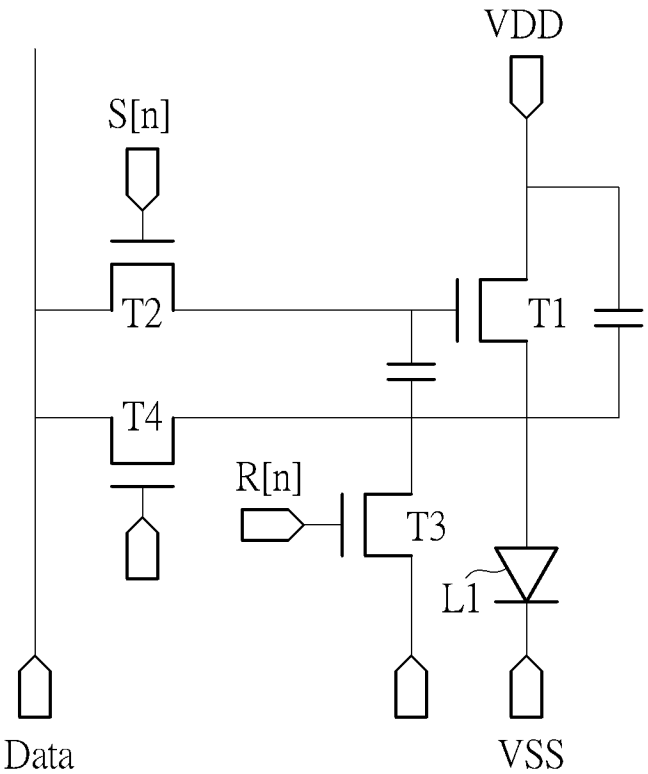

In FIG. 7A, the pixel cell includes transistors T1-T7 and an OLED L1. The transistor T1 is the OLED driver, such as a TFT, for converting the received voltage data signal to a driving current, in order to drive the OLED L1 to emit light. The transistor T2 is a scan switch for receiving the display data; that is, the transistor T2 is controlled by a scan signal S [n], to determine the time for receiving the display data. The transistor T3 is a reset switch, which resets to delete the data stored in the pixel cell in the initial phase according to a reset signal R [n]. The transistor T4 is a compensation switch, which is closed to let the transistor T1 to become diode-connected, in order to find out the threshold voltage of the transistor T1 according to the behavior of the transistor T1. The threshold voltage can be eliminated in this manner. The transistors T5 and T6 are emission switches for controlling the OLED L1 to emit light; that is, the OLED L1 receives the driving current to emit light when the emission switches are closed according to the control of emission signals EM [n] and EM2 [n]. The transistor T7 is used for providing a reverse-biased for the OLED L1, to recover the status of electronics in the OLED L1.

FIGS. 7B-7E illustrate alternative circuit structures of pixel cells with internal compensation functions; hence, the signals and circuit elements having similar functions are denoted by the same symbols. The detailed operations of these pixel cells are illustrated in the above paragraphs, and will not be narrated herein.

As mentioned above, the internal compensation has a limited compensation range. If the mismatch of the threshold voltage exceeds this range, the exceeding part of the mismatch of the threshold voltage may further be measured by the external compensation module and compensated via the LUT. As a result, the present invention can deal with a larger mismatch of threshold voltage and is applicable to an OLED display panel of an electronic product having a longer life.

Figure 8:
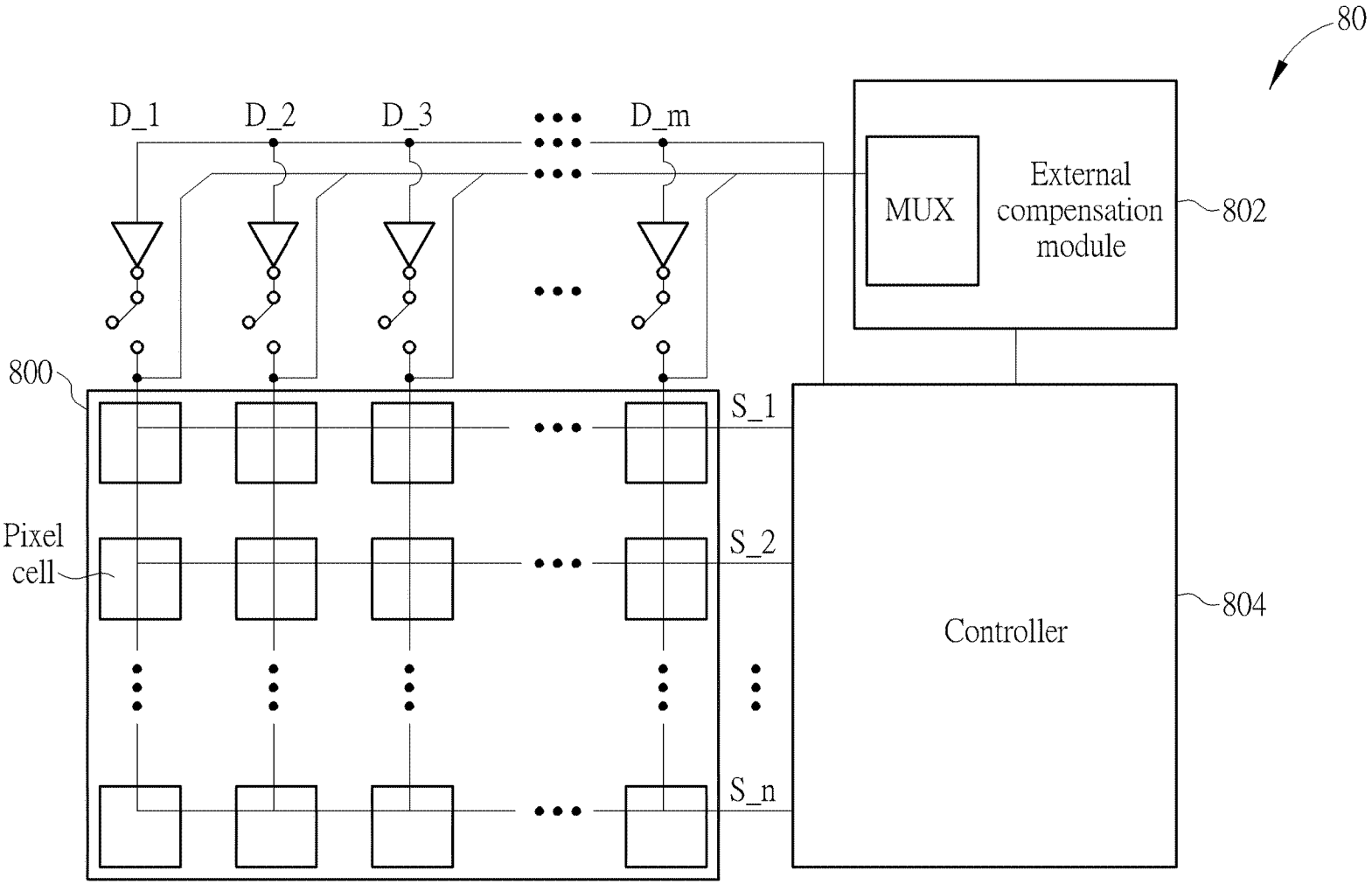
FIG. 8 is a schematic diagram of a display system according to an embodiment of the present invention.

Please refer to FIG. 8, which is a schematic diagram of a display system 80 according to an embodiment of the present invention. The display system 80 includes an OLED display panel 800, an external compensation module 802 and a controller 804. The OLED display panel 800 includes a plurality of pixel cells, each of which includes an OLED and a transistor such as a TFT (not illustrated). The external compensation module 802 is used for measuring the electronic mobility and the oxide capacitance of the transistors in the pixel cells and the luminous efficiency of the OLEDs in the pixel cells. The external compensation module 802 may include a multiplexer (MUX), which controls the external compensation module 802 to selectively perform compensation on any pixel cells. The number of measured pixel cells and which cells are measured should not be limitations of the present invention.

A LUT is generated according to the compensation result of the external compensation module 802. The controller 804 then converts the original display data to the target display data D_1-D_m according to the LUT, and outputs the target display data D_1-D_m to the pixel cells on the OLED display panel 800. The controller 804 further outputs scan signals S_1-S_n to the pixel cells on the OLED display panel 800, to selectively control specific pixel cell(s) to receive the target display data D_1-D_m. Subsequently, the threshold voltage of the transistor (s) in the pixel cell (s) is compensated when the target display data D_1-D_m is received by the pixel cell (s). The detailed operations of the display system 80 are described above, and will not be narrated herein.

In summary, the present invention provides a method of compensating luminance of an OLED operated with a transistor in a pixel cell of a display panel. The electronic mobility and the oxide capacitance of the transistor and the luminous efficiency of the OLED are measured by an external compensation module, and a LUT is generated accordingly. A target display data is generated after the compensation is performed according to the LUT. A circuit structure having internal compensation functions is further applied to compensate the threshold voltage of the transistor. Therefore, the mismatch of the threshold voltage of the transistor is eliminated via circuit designs in the pixel cell without any calculation. This prevents complex square calculation and saves the computation resources and memories for the calculation. In addition, the compensation performed based on the LUT can also achieve a larger compensation range.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of compensating luminance of an organic light-emitting diode (OLED) operated with a transistor in a pixel cell of a display panel, comprising:

measuring an electronic mobility and an oxide capacitance of the transistor and a luminous efficiency of the OLED, and generating a first lookup table comprising information for compensating the electronic mobility and the oxide capacitance of the transistor without compensating a threshold voltage of the transistor and a second lookup table comprising information for compensating the luminous efficiency of the OLED;

converting original display data to target display data according to the first lookup table and the second lookup table;

outputting the target display data to the pixel cell; and compensating the threshold voltage of the transistor when the target display data is received by the pixel cell;

wherein the compensation of threshold voltage is an internal compensation performed by the pixel cell.

2. The method of claim 1, wherein the step of converting original display data to target display data according to the first lookup table and the second lookup table comprises:

performing a transistor compensation to allow a voltage mismatch existing between a voltage value of the transistor and a target voltage value, wherein the voltage mismatch is within a specific range that is able to be dealt with by compensating the threshold voltage.

3. The method of claim 1, wherein the first lookup table and the second lookup table indicate a compensation value for converting the original display data to the target display data.

4. A display system, comprising:

a display panel, comprising a plurality of pixel cells, each of which comprising an organic light-emitting diode (OLED) operated with a transistor;

an external compensation module, for measuring an electronic mobility and an oxide capacitance of the transistor and a luminous efficiency of the OLED, and generating a first lookup table comprising information for compensating the electronic mobility and the oxide capacitance of the transistor and a second lookup table comprising information for compensating the luminous efficiency of the OLED; and a controller, for converting original display data to target display data according to the first lookup table and the second lookup table, and outputting the target display data to one of the plurality of pixel cells;

wherein the threshold voltage of the transistor is compensated when the target display data is received by the pixel cell;

wherein the compensation of the threshold voltage is an internal compensation performed by the pixel cell.

5. The display system of claim 4, wherein the controller performs a transistor compensation to allow a voltage mismatch existing between a voltage value of the transistor and a target voltage value, wherein the voltage mismatch is within a specific range that is able to be dealt with by compensating the threshold voltage.

6. The display system of claim 4, wherein the first lookup table and the second lookup table indicate a compensation value for converting the original display data to the target display data.

* * * * *